US006571404B2

(12) United States Patent
Hall

(10) Patent No.: US 6,571,404 B2
(45) Date of Patent: Jun. 3, 2003

(54) ABOVE GROUND POOL

(76) Inventor: David E. Hall, 3418 47$^{th}$ Ave., Rock Island, IL (US) 61201

( * ) Notice: Subject to any disclaimer, the term of this patent is extended or adjusted under 35 U.S.C. 154(b) by 0 days.

(21) Appl. No.: 09/451,462

(22) Filed: Nov. 30, 1999

(65) Prior Publication Data

US 2002/0016989 A1 Feb. 14, 2002

(51) Int. Cl.$^{7}$ ..... E04H 4/00
(52) U.S. Cl. ..... 4/506; 52/169.7
(58) Field of Search ..... 4/506; 52/169.7, 52/584.1

(56) References Cited

U.S. PATENT DOCUMENTS 3,142,069 A * 7/1964 O'Connell et al. ..... 4/506 X
3,445,866 A * 5/1969 Shields ..... 4/506
4,562,603 A * 1/1986 Paradis ..... 4/506
5,010,603 A * 4/1991 Hertzog ..... 4/506
5,231,807 A * 8/1993 Aymes ..... 4/506 X
5,277,004 A * 1/1994 Frei ..... 52/169.7

* cited by examiner

*Primary Examiner*—Charles E. Phillips
(74) *Attorney, Agent, or Firm*—Harsha & Associates

(57) ABSTRACT

An above ground pool having identical sized panels coupled together to form the perimeter of the pool. Post structures located at the union of adjacent panels include angle members that span the union of adjacent panels and determine the angle at which adjacent panels extend with respect to each other. Different sets of angle members can be utilized to form different angles between adjacent panels to establish different sizes of pools having different numbers of panels.

18 Claims, 5 Drawing Sheets

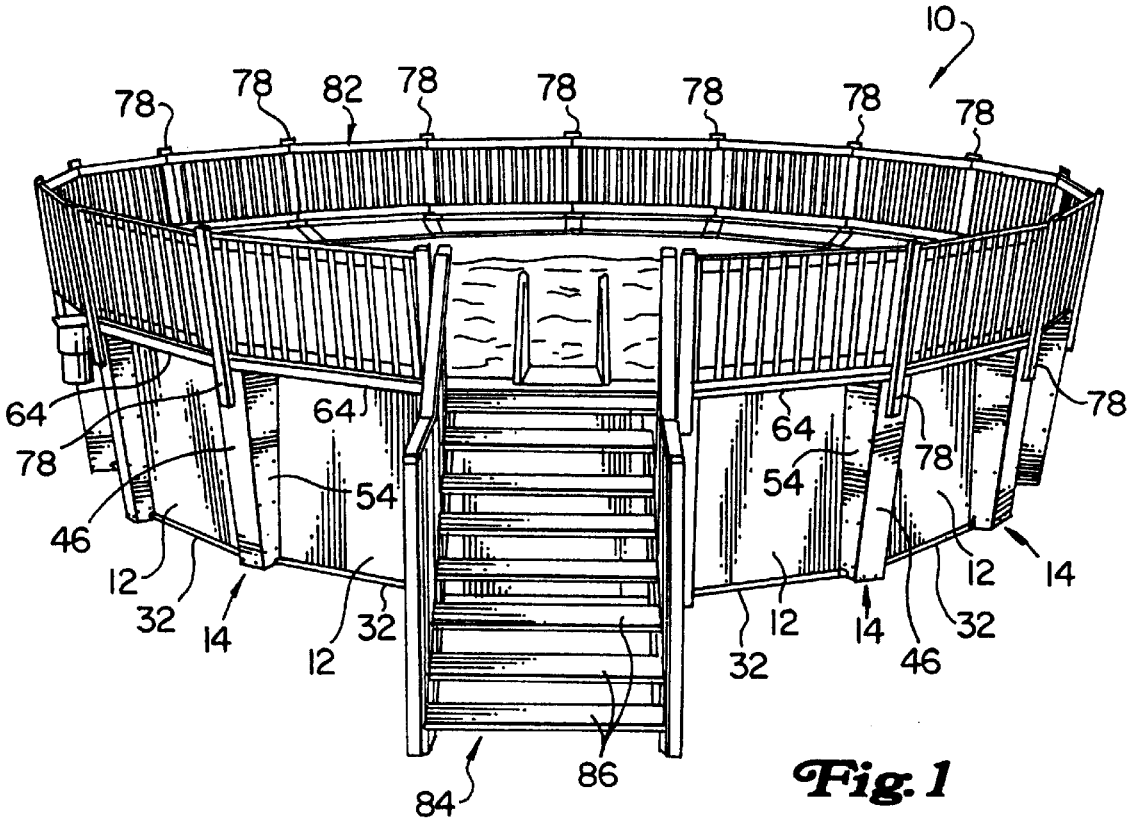
Fig. 1
Fig. 2
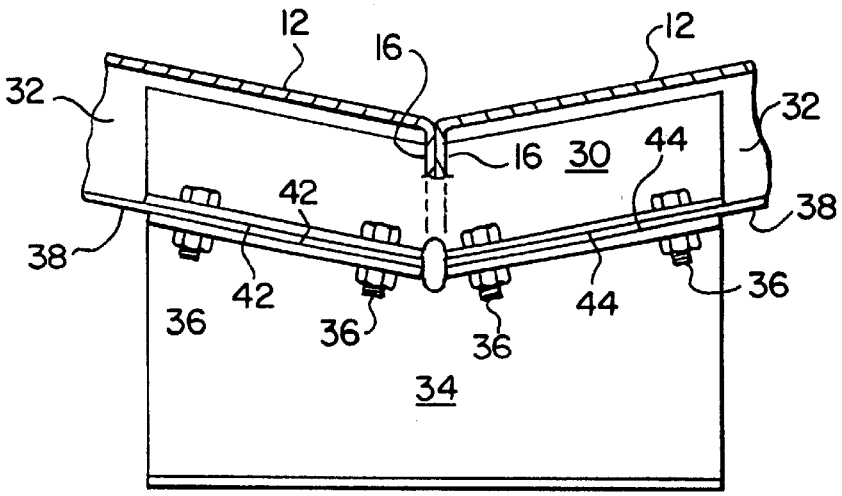

10
82
82
74
72
76
100
64
72
74
80
22
90
78
28
12
80
96
94
56
56
46
56
18
54
60
14
110
58
56
56
12
62
106
56
108
56
92
52
50
52
34
36
56
38
104
32

82
78
64
100
76
100
100
100
74
72
68
66
22
70
70
88
90
92
48
24
26
28
20
96
16
18
12
94
110
96
58
80
46
62
46
14
50
36
34
52
38
32
30
104

ABOVE GROUND POOL

BACKGROUND OF THE INVENTION

This invention relates to above ground pools and methods of varying the size of above ground pools.

It is known to provide above ground swimming pools which are constructed from a large roll of corrugated metal material. The corrugated metal sheet is unrolled to form a circular shape that will define the perimeter of the pool. The ends of the corrugated material are then fixed together as by bolts. Posts can then be inserted into the ground along the outer edge of the corrugated material to add strength to the structure. A liner is installed on the interior of the corrugated metal perimeter. The liner can then be filled with water and the pool is ready for use.

Conventional pools such as this have several disadvantages. The assembly of the large roll of corrugated metal often requires several persons to assist in unrolling the corrugated metal piece and holding it in the proper position for the ends to be fixed together. Several persons are also utilized to hold the corrugated piece in position as the liner is inserted and the pool is filled with water. The flexible nature of the corrugated material can make these operations relatively difficult, particularly in windy conditions. The bolts which hold together the ends of the corrugated roll can eventually wear holes in the liner, which will cause the pool to leak. This conventional type of pool often requires a separate structure to be built around the perimeter of the pool to provide a walkway for persons using the pool. A fence around the pool is also often required by local law, and therefore a fence structure must typically be built separate from the pool structure.

In order to assemble such pools in different diameters as requested by customers, a pool assembly company will typically stock corrugated rolls having different lengths which correspond to the different pool diameters. These different sizes of corrugated rolls can undesirably occupy a relatively large amount of storage space. The large number of relatively costly corrugated rolls in storage also represent significant inventory costs for a pool construction company.

It would therefore be desirable to provide a sturdy above ground pool that is relatively easy to assemble, even in windy conditions. It would be desirable for such a pool to be easily assembled by as few as two persons. It would be desirable for such a pool to reduce inventory costs associated with storing parts for a variety of different sized pools. It would also be desirable for such a pool to reduce or eliminate the problems associated with the liner being worn through by the bolts that fix the ends of the corrugated metal roll together. It would also be desirable for such a pool to provide sturdy walkway and fence structures that are easy to assemble and relatively inexpensive.

SUMMARY OF INVENTION

A pool assembly company utilizing the above ground pool according to the present invention will store in inventory a plurality of the rigid rectangular panels which are of generally the same size and shape. The panels are adapted to be coupled together to form the perimeter of a generally circular pool. The pool assembly company will also store a plurality of sets of different angle members which when coupled with the panels determine the angle between adjacent panels. The different sets of angle members therefore determine different sizes of pools having different numbers of panels. The pool assembly company will select from its inventory a number of panels which correspond to a particular size of pool, and will select a set of angle members which correspond to the desired size of pool to be constructed. The pool assembly company will then construct a pool in the particular size using the panels and set of angle members selected from its inventory. During the assembly of the pool the angle members are coupled to extend across unions of adjacent panels. A first surface of the selected angle members is placed against a surface of a panel and a second surface of the selected angle members is placed against a surface of an adjacent panel. The first and second surfaces of the angle plates extend at a fixed angle to define the angle at which the adjacent panels extend with respect to each other to establish the particular size of the pool.

The angle members of the preferred embodiment of the present invention further comprise top inner degree angle plates that fit within an upper channel formed in the upper edge of adjacent panels. Top outer degree angle plates are coupled with the outer edge of the upper channels of adjacent panels. Bottom inner degree angle plates fit within a bottom channel along the bottom edge of adjacent panels. Bottom outer degree angle plates are coupled with the outer surface of the bottom channels of adjacent panels. An upright support member is fixed at its upper end to each top outer degree angle plate and at its bottom end to respective bottom outer degree angle plates. A side skirt is bolted to each side of each upright support. The side skirt is also fixed to a rigidizer that is bolted to side flanges of adjacent panels.

A walkway is fixed as by bolts to brackets coupled to the upper portions of the upright support members. Finish cover plates bridge the gap between the ends of adjacent walkway members, which are generally the same length as the panel members.

Fenceposts are fixed as by bolts to the outer surface of the upright supports. A wooden fence can be installed to extend between adjacent fenceposts to block unwanted access to the pool. An entry structure such as a stairs can be installed that allows easy access to the walkway and pool. The stairs can include a fence and gate that further act as a barrier to entry to the pool when the gate is closed.

BRIEF DESCRIPTION OF THE DRAWINGS

FIG. 1 is perspective view of an assembled pool according to the preferred embodiment of the present invention.

FIG. 2 is a top sectional view of the bottom inner degree angle plate and the bottom outer degree angle plate bolted to the bottom channels of adjacent panels prior to attachment of the upright supports.

DETAILED DESCRIPTION OF THE PREFERRED EMBODIMENT

Figure 3:
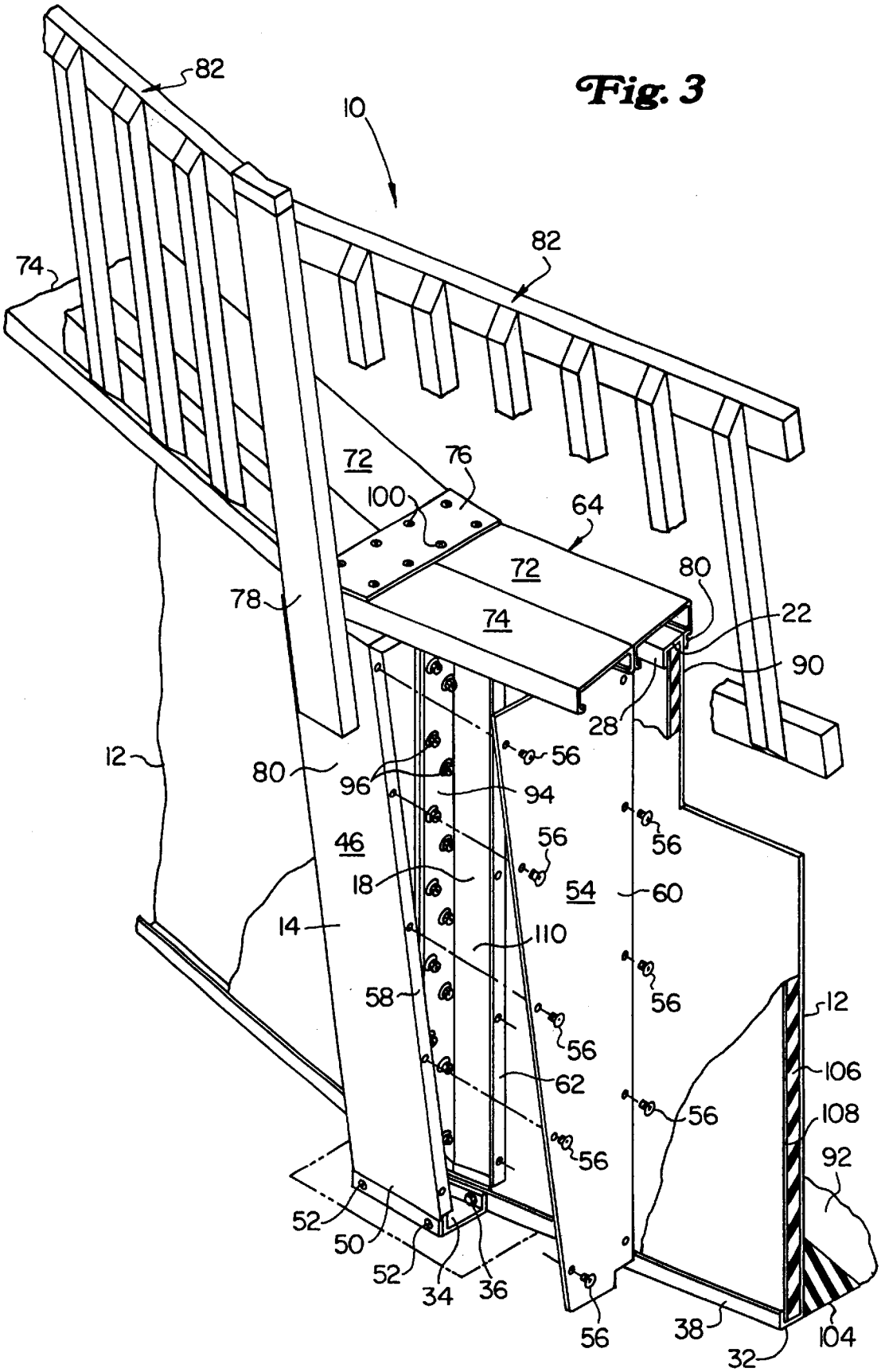
FIG. 3 is a partially exploded perspective view of the post structure, walkway and fence according to the present invention.
Figure 4:
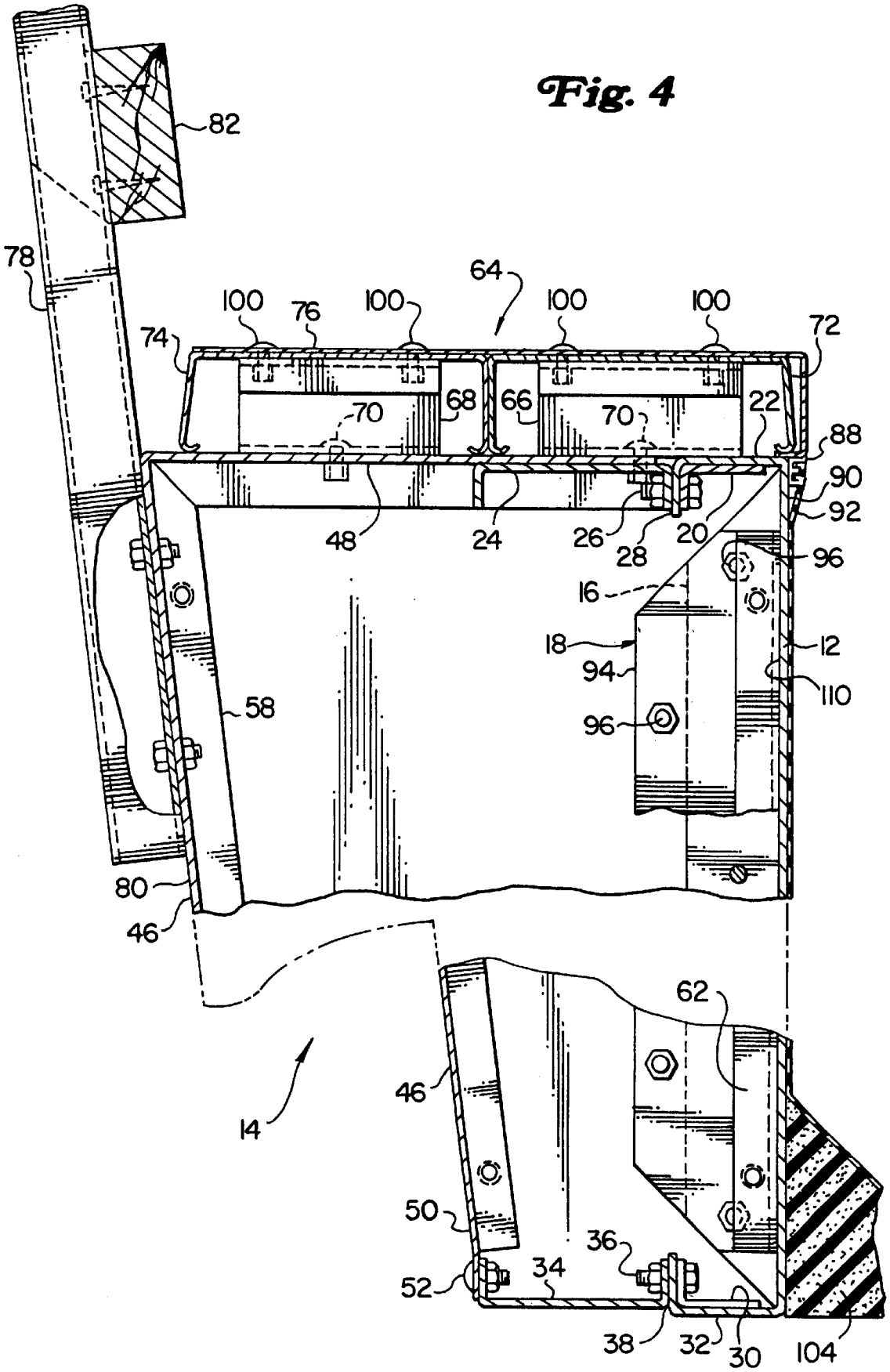
FIG. 4 is a sectional side view of the post structure, walkway and fence according to the present invention.
Figure 5:
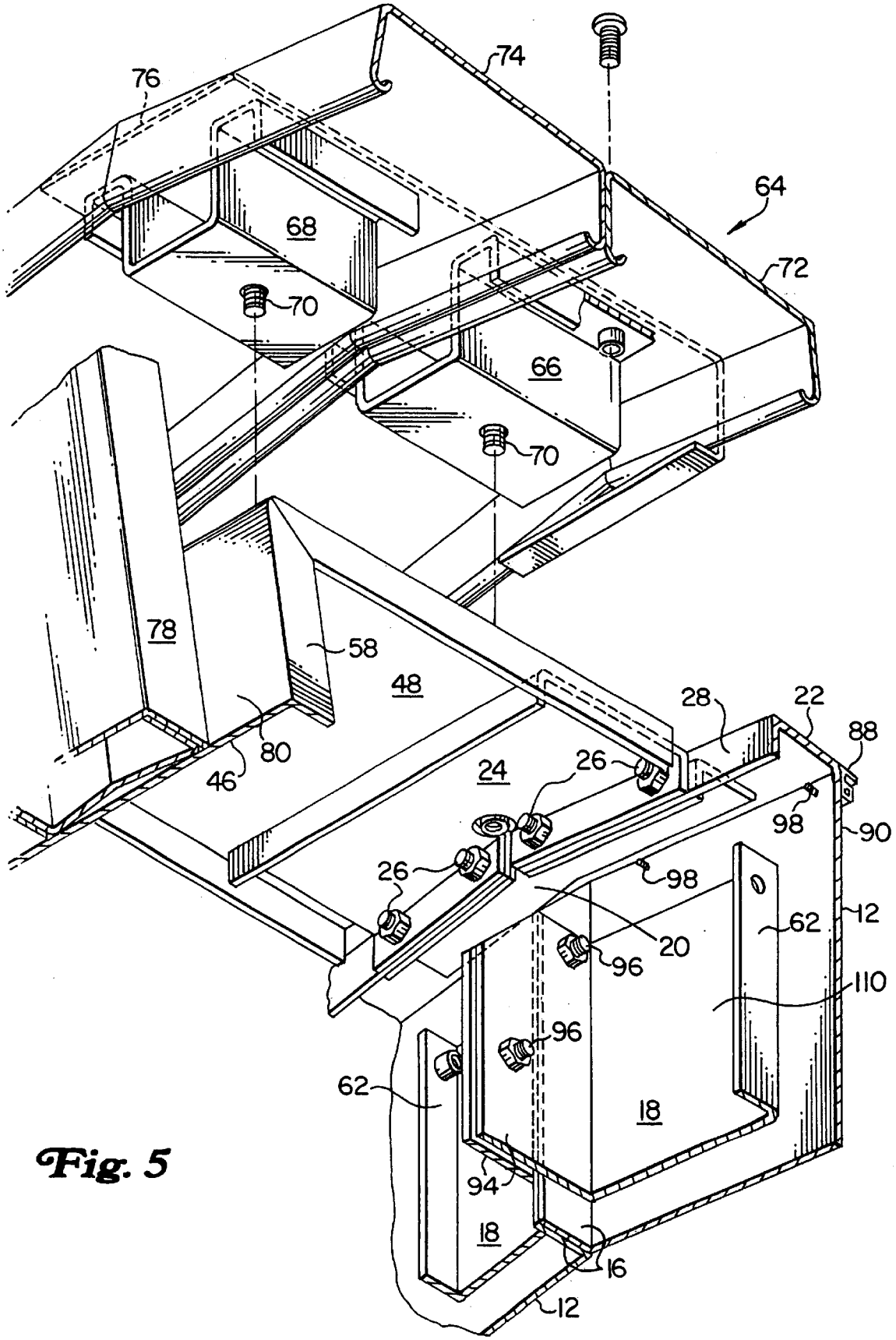
FIG. 5 is a partially exploded perspective view from ground level showing the upper portion of the post structure and the walkway according to the present invention.
Figure 6:
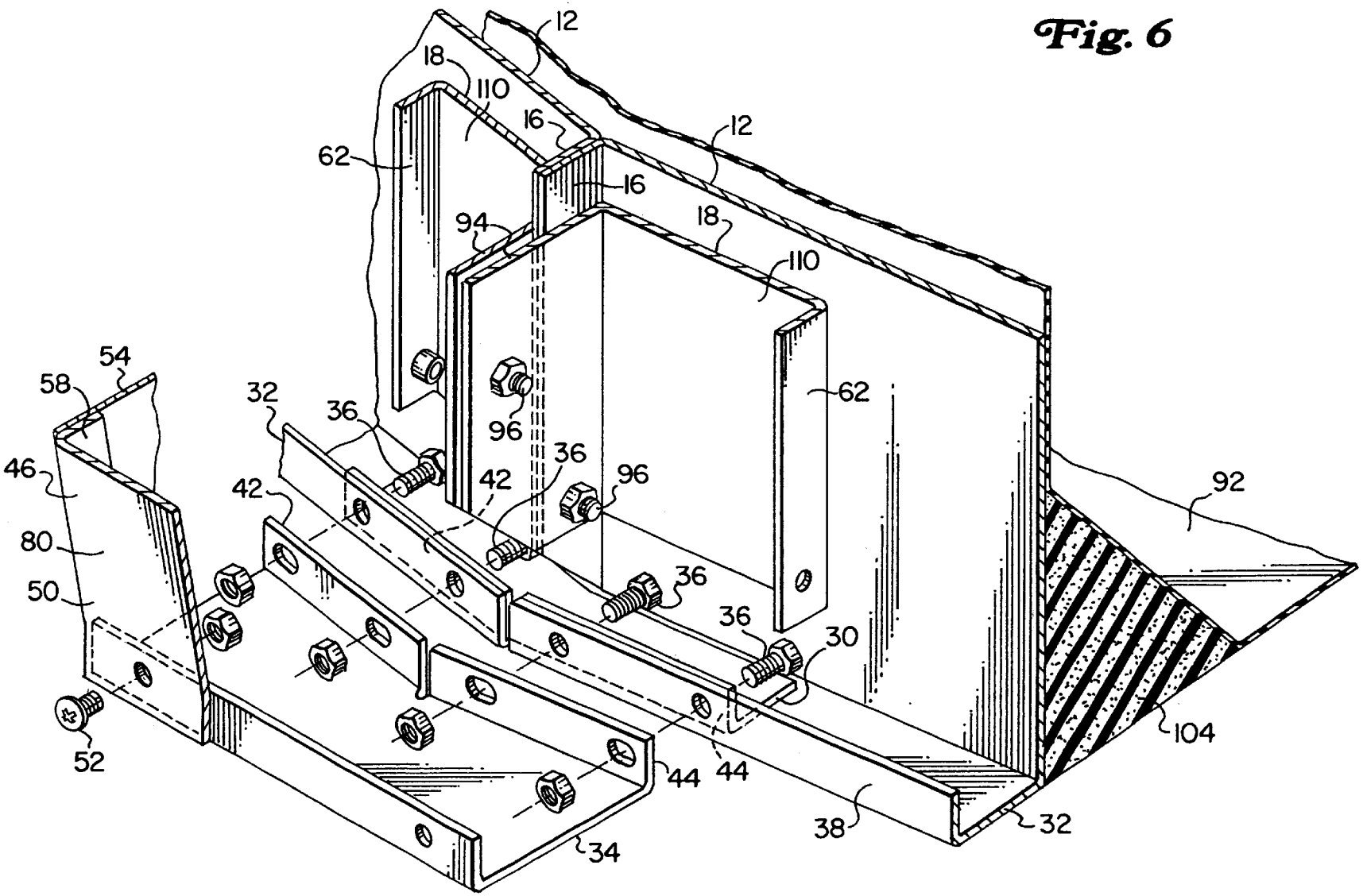
FIG. 6 is a partially exploded perspective view from above showing the lower portion of the post structure according to the present invention.

Referring to FIGS. 1–6, there is shown the pool 10 according to the present invention. The pool 10 includes a number of equal sized 12 panels that form the perimeter of the pool 10. Adjacent panels 12 are coupled together by identical post structures 14 according to the present invention. Therefore, only one post structure 14 will be described in detail, since each union of adjacent panels 12 provides an identical post structure 14 according to the preferred embodiment.

The panels 12 include side flanges 16 to which rigidizer members 18 are bolted to operatively fix the panels 12 together and strengthen the union of the joined panels. A top inner degree angle plate 20 is installed across the union of adjacent panels 12 within top channels 22 of adjacent panels 12. A top outer degree angle plate 24 is fixed as by bolts 26 across the union of adjacent panels 12 and to the outer surface 28 of upper channel portions 22 of the panels 12. Bottom inner degree angle plates 30 are fixed in position across the union of adjacent panels 12 within a bottom channel 32 of the panels 12. A bottom outer degree angle plate 34 is fixed as by bolts 36 to the outer edge 38 of the bottom channels 32. The degree angle plates 20, 24, 30, 34 include angled first and second surfaces 42, 44 which abut adjacent panels 12 to thereby determine the angle at which the adjacent panels 12 extend to each other. The diameter of the pool 10 is determined by the angle between adjacent panels 12, and therefore the angles established by the degree angle plates 20, 24, 30, 34 determines the diameter of the pool 10 being constructed.

An upright support member 46 is attached at its upper end 48 to each top outer degree angle plate 24. The lower end portion 50 of the upright support member 46 is attached as by bolts 52 to the bottom outer degree angle plate 34. A side skirt 54 is then attached as by bolts 56 to each side flange 58 of the upright support 46. The inner edge portion 60 of each side skirt 54 is bolted to an outer flange or leg 62 of a respective rigidizer member 18.

The upper portion 48 of the upright support member 46 forms a ledge to which a walkway 64 can be supported. A pair of top seat connector brackets 66, 68 are attached as by bolts 70 to the upper portion 48 of the upright support member 46. Top seat walkway members 72, 74 can then be fixed to the top seat connector brackets 66, 68. A finish cover plate 76 is installed to cover the ends of the top seat walkway members 72, 74 and the top seat connector brackets 66, 68.

Fence posts 78 can be fixed to the back surface 80 of the upright support members 46, and extend upwardly therefrom. A fence 82 made of wood material can then be constructed to extend between the fence posts 78 of adjacent post structures 14, thereby establishing a continuous fence 82 around the perimeter of the pool 10. An entry structure 84 such as an A-frame structure can also be constructed that provides stairs 86 for access onto the walkway 64. The entry structure 84 may also be fenced and gated to prevent access to the pool 10 when the gate is closed.

A coping 88 is attached to the top edge 90 of the interior of the panels 12. A water-tight liner 92 is coupled with the coping 88. Once coupled with the coping 88 the liner 92 can be filled with water to a desired level.

Next, the assembly of the pool 10 according to the present invention will be described in greater detail. First, the locations of the unions of adjacent panels 12 is determined. Marks are made on the ground at the location of the unions. A pair of panels 12 are held together such that the union of the panels 12 is directly over one of the marks. Side flanges 16 of the panels 12 are brought into contact over the mark, and rigidizer members 18 are positioned on either side of the abutting side flanges 16. Openings are aligned in the side flanges 16 and first flanges or legs 94 of the rigidizers 18 such that bolts 96 can then be passed through the rigidizers 18 and side flanges 16. Nuts are then tightened onto the bolts to compress the rigidizer members 18 and side flanges 16 tightly together.

Next, the top degree angle plates 20, 24 are attached to panels 12 that have just been joined together. A top inner degree angle plate 20 is inserted underneath an upper channel 22 formed along the top edge 90 of the adjacent panels 12. The side flanges 16 of the adjacent panels 12 do not extend to the very top of the panels 12, and therefore clearance is provided for the top inner degree angle plate 20 to extend across the union of the adjacent panels 12. A top outer degree angle plate 24 is then positioned in abutment with the outer surface 28 of the upper channels 22 of the adjacent panels 12 across the union of the panels 12. Openings in the upper channels 22 and the top outer and top inner degree angle plates 20, 24 are aligned so that bolts 26 can pass therethrough. Nuts are then tightened onto the bolts 26, which presses the top outer and top inner degree angle plates 20, 24 securely against the upper channels 22.

The bottom degree angle plates 30, 34 are then attached to adjacent panels 12. A bottom inner degree angle plate 30 is positioned within a bottom channel 32 at the lower edge of the panels 12. The side flanges 16 of the panels 12 do not extend down to the lowermost edge of the panels 12, and clearance is provided for the bottom inner degree angle plate 30 to fit within the bottom channels 32. The inner degree angle plate 30 is positioned to extend across the union of the adjacent panels 12. A bottom outer degree angle plate 34 is positioned against the outer surface 38 of the bottom channel 32 and in position to span the union of the adjacent panels 12. Openings in the bottom channel 32 and bottom inner and bottom outer degree angle plates 30, 34 are aligned and bolts 36 inserted into the openings. Nuts are then tightened onto the bolts 36 to securely press the bottom inner and bottom outer degree angle plates 30, 34 against the bottom channel 32.

The upright supports 46 are then attached. The upper portion 48 of the upright support 46 is placed on top of the top outer degree angle plate 24. The lower edge of the upright support 50 is bolted to an outer flange of the bottom outer degree angle plate 34. A sideskirt 54 is then attached to each side of the upright support 46. The outer edge of the sideskirts 54 are fastened to a flange 58 of the upright support 46. The inner portion 60 of the sideskirt 54 is fastened to a second flange portion 62 of the rigidizer member 18.

A coping strip 88 can then be attached to the upper edge 90 of the inner surface of the panels 12. The coping strip 88 is cut at appropriate locations to establish the angles necessary at the unions of adjacent panels 12. The coping 88 is attached using self drilling tek screws 98 at three inch intervals. The coping 88 will provide a structure to which the pool liner 92 can be attached.

Next, a walkway 64 is installed along the top edge 90 of the panels 12. A pair of top seat connector brackets 66, 68 are fixed as by bolts 70 on top of the upper portion 48 of the upright support 46. The bolt 70 in the innermost bracket 66 passes through the upper portion 48 of the upright support 46 and through the top outer degree angle plate 24 for securing the upper portion 48 of the upright support 46 to the top outer degree angle plate 24. Inner top seat walkways 72 are positioned to generally span the length of the panels 12 and are bolted to the innermost brackets 66. Outer top seat walkways 74 are positioned adjacent the inner top seat walkway 72, and are bolted to the outermost brackets 68. A finish cover plate 76 can then be installed directly over the brackets 66, 68. The finish cover plate 76 spans any gap between adjacent inner top seat walkways 72, and between adjacent outer top seat walkways 74. Fasteners 100 with rounded heads are used to attach the finish cover plates 76 to the top seat walkways 72, 74 and brackets 66, 68, which generally reduces the occurrence of stubbed toes against the fasteners 100.

The union of adjacent panels 12 can then be duct taped to provide a smooth surface between adjacent panels 12. This will make the liner 92 look smoother when installed. A foam padding 102 can be installed on the ground where the floor of the pool 10 will be. A flexible material 104 can then also be installed inside the lowermost edge of each panel 12. The liner 92 can then be installed by unfolding the pool liner 92 within the pool 10 and snapping the upper edge of the liner 92 into the groove defined by the coping 88. Once the liner 92 is installed, openings can be cut in the liner for the skimmer and return lines. Openings in particular panels are pre-formed to accommodate the skimmer and two return lines. Once the openings are formed in the liner 92 for the skimmer and return lines the liner 92 can start to be filled with water. The skimmer and return lines can then be attached to the panels 12.

Fenceposts 78 can then be fastened to the outer surface 80 of the upright support 46. The fenceposts 78 extend upwardly from the upright supports 46, and provide structure to which a wooden fence 82 can be fixed. The wooden fence 82 can extend between adjacent fenceposts 78 and can serve as a barrier to entry into the pool 10.

A structure 84 such as stairs 86 can be constructed to allow swimmers to easily ascend to the walkway 64 at the edge of the pool 10. The stairs 86 can be provided with fencing and a gate that when closed will generally block persons from accessing the pool 10.

Insulation 106 can be applied to the pool 10 for helping the water within the pool 10 retain heat. Sheets of insulation 106 can be positioned against the exterior surfaces of the panels 12. A thin flexible piece of sheet metal 108 can then be flexed slightly and inserted within the top and bottom channels 22, 32 of the panel 12 to thereby secure the sheet of insulation 106 against the outer surface of the panel 12.

The present invention provides a relatively rigid post structure 14 positioned at the union of adjacent panel members 12. The post members 14 establish a rigid structure that serve to contain the panels 12 in proper position. The upright supports 46, the degree angle plates 20, 24, 30, 34, the rigidizer members 18 and the side skirts 54 are all coupled together to establish a rigid post structure 14. The top seat connector brackets 66, 68, top seat walkways 72, 74 and finish cover 76 provide rigid structure that spans between post structures 14 and thereby further secure the post structures 14 in proper position and generally enhance the rigidity of the pool 10. The pool 10 according to the present invention therefore provides a relatively strong and sturdy structure when assembled that is capable of withstanding large forces during the life of the pool 10. The rigidizers 18 help strengthen the union of adjacent panels 12. The first leg 94 of the rigidizers 18 are bolted to the side flange 16 of a panel 12, and a second leg 110 of the rigidizer 18 abuts the exterior surface of the panel 12 for added support and strength in that area.

The pool 10 according to the present invention provides panels 12 that are coupled together one at a time. This allows as few as two operators to assemble the pool 10. The panels 12 according to the present invention are relatively small and therefore can be assembled even in windy conditions, whereas the type of pool utilizing a large roll of corrugated metal can require many persons to hold in place during assembly and can be difficult or impossible to assembly during windy conditions.

The panels 12 according to the present invention include side flanges 16 that are operatively bolted together on the exterior of the pool 10. The bolts 96 that couple the panels 12 together are not in contact with the liner 92 and therefore the liner 92 will not become worn or tear in this area. The present invention therefore eliminates wear on the liner 92 caused by contact with bolts.

The pool 10 according to the present invention allows many different sizes of pools to be assembled using only a single size of panel 12. Different numbers of panels 12 are used for different sizes of pools 10. The panels 12 extend at slightly different angles to one another in different sizes of pools 10. The degree angle plates 20, 24, 30, 34 include first and second surfaces 42, 44 that extend at an angle to each other. The first and second surfaces 42, 44 operatively abut respective adjacent panels 12 and therefore establish the angle at which adjacent panels 12 are oriented to each other. For example, a pool 10 according to the present invention having a diameter of twenty-one feet includes a total of fifteen panels 10, and adjacent panels 12 form an interior angle of one-hundred-fifty-six degrees. The degree angle plates 20, 24, 30, 34 for such a pool include first and second surfaces extending at a one-hundred-fifty-six degree angle to each other and thereby ensure that adjacent panels 12 extend at the proper one-hundred-fifty-six degree angle to each other that establishes a twenty-one foot diameter pool. A pool having a diameter of thirty feet, on the other hand, includes twenty-one panels 12, and adjacent panels 12 extend at one-hundred-sixty-two degree angles to each other. The degree angle plates 20, 24, 30, 34 for such a pool include first and second surfaces 42, 44 extending at a one-hundred-sixty-two degree angle to each other and thereby ensure that adjacent panels 12 extend at the proper one-hundred-sixty-two degree angle to each other for establishing a 30 foot diameter pool.

A pool assembly company utilizing the above ground pool 10 according to the present invention will store in inventory a plurality of the rigid rectangular panels 12 which are of generally the same size and shape. The panels 12 are adapted to be coupled together to form the perimeter of a generally circular pool 10, as described above. The pool assembly company will also store a plurality of sets of different angle members 20, 24, 30, 34 which when coupled with the panels 12 determine the angle between adjacent panels 12. The different sets of angle members 20, 24, 30, 34 therefore determine different sizes of pools 10 having different numbers of panels 12. The pool assembly company will select from its inventory a number of panels 12 which correspond to a particular size of pool, and will select a set of angle members 20, 24, 30, 34 which correspond to the desired size of pool 10 to be constructed. The pool assembly company will then construct a pool 10 in the particular size using the panels 12 and set of angle members 20, 24, 30, 34 selected from its inventory. During the assembly of the pool 10 the angle members 20, 24, 30, 34 are coupled to extend across unions of adjacent panels 12. A first surface 42 of the selected angle members 20, 24, 30, 34 is placed against a surface of a panel 12 and a second surface 44 of the selected angle members 20, 24, 30, 34 is placed against a surface of an adjacent panel 12. The first and second surfaces 42, 44 of the angle plates 20, 24, 30, 34 extend at a fixed angle to define the angle at which the adjacent panels 12 extend with respect to each other to establish the particular size of the pool 10.

If several pools according to the present invention are assembled having different diameters, some parts will be the same in each pool. The panels 12, upright support members 46, rigidizers 18, side skirts 54, top seat walkways 72, 74, top seat connector brackets 66, 68, fence posts 78 and assorted fasteners are common parts utilized in all sizes of pools 10. All these components are identical regardless of the size of the pool 10 being constructed according to the present invention. Only a relatively small number of parts will be different in different sizes of pools. The degree angle plates 20, 24, 30, 34 are unique to the size of pool 10 being assembled, and therefore are different parts in different sized pools. The commonality of a relatively large number of parts allows a pool assembly company to stock a large volume of those parts for use no matter what size pool 10 is being assembled. This commonality of parts which generally stack easily and do not occupy a large volume of warehouse space helps reduce the inventory costs incurred by the pool assembly company. The pool assembly company will be required to stock a variety of different sizes of degree angle plate sets which correspond to different sizes of swimming pools 10. The sets of degree angle plates 20, 24, 30, 34 are relatively inexpensive and small and will not occupy a large amount of warehouse space, even if a large variety of sets are maintained in inventory. The present invention therefore generally reduces the amount of warehouse space that must be dedicated to unassembled pools of different sizes. Furthermore, since the non-common parts, namely the degree angle plates 20, 24, 30, 34, are relatively inexpensive, the pool assembly company will have only a relatively small amount of cash tied up in inventory. The cash tied up in inventory is largely associated with the common parts which can be used no matter what size pool is ordered. Therefore the pool assembly company does not have to face the possibility of having large volumes of costly inventory associated with pool sizes which might remain in inventor for long periods of time. The pool 10 according to the present invention provides economic advantages of generally minimizing inventory costs and storage costs associated with carrying different sized pools in inventory.

The present invention provides angle members 20, 24, 30, 34 that determine the angle of adjacent panels 12. Within the spirit of present invention, the pools 10 according to the present invention can be assembled using fewer than four such angle members at each union of adjacent panels 12, but the pools 10 according to the present invention preferably include four angle members 20, 24, 30, 34 at each union of adjacent panels 12.

What is claimed is:

1. A pool, comprising:

a plurality of similarly sized and generally rigid panels, said panels having side flanges extending along the side edges of the panels and an upper channel extending along the upper edge of the panels, a plurality of degree angle members coupled between each adjacent panel side flange, said degree angle members having a top outer degree angle plate positioned against an outer surface of the upper channels of adjacent panels, said top outer degree angle plates defining the first and second surfaces of the degree angle members which abut the outer surfaces of the upper channels of adjacent panels, said degree angle members also having first and second surfaces extending at identical fixed angles to each other and in contact with the side flanges of adjacent panels, said fixed angles corresponding with the generally equal angles between the adjacent panels to ensure that adjacent panels extend at the proper angle to each other; and, said adjacent panels fixed together to define the perimeter of the pool.

2. The pool of claim 1, wherein the angle members further comprise a top outer degree angle plate positioned against an outer surface of the upper channels of adjacent panels, said top outer degree angle plates define first and second surfaces which abut the outer surfaces of the upper channels of adjacent panels for determining the angle between adjacent panels.

3. The pool of claim 2 wherein said panels further comprise an bottom channel extending along the bottom edge of the panels, and the angle members include a bottom outer degree angle plate positioned against an outer surface of the bottom channels of adjacent panels, said bottom outer degree angle plates define the first and second surfaces of the angle members which abut the outer surfaces of the bottom channels of adjacent panels.

4. The pool of claim 1, wherein said panel further comprises a bottom channel extending along the lower edge of the panels, and the angle members further comprise a bottom inner degree angle plate positioned within the bottom channels of adjacent panels, said bottom inner degree angle plate defines first and second surfaces of the angle members.

5. The pool of claim 1, wherein said panels further comprise an upper channel extending along the upper edge of the panels, and the angle members further comprise a top inner degree angle plate positioned within the upper channels of adjacent panels, and the top inner degree angle plate defines the first and second surfaces of the angle members.

6. The pool of claim 1, wherein said panel further comprises a bottom channel extending along the lower edge of the panels, and the angle members further comprise a bottom inner degree angle plate positioned within the bottom channels of adjacent panels, said bottom inner degree angle plate defines first and second surfaces of the angle members.

7. The pool of claim 1, wherein said panels further comprise a bottom channel extending along the bottom edge of the panels, and the angle members include a bottom outer degree angle plate positioned against an outer surface of the bottom channels of adjacent panels, said bottom outer degree angle plates define the first and second surfaces of the angle members which abut the outer surfaces of the bottom channels of adjacent panels.

8. The pool of claim 1, wherein said panels further comprise an bottom channel extending along the bottom edge of the panels, and the angle members include a bottom outer degree angle plate positioned against an outer surface of the bottom channels of adjacent panels, said bottom outer degree angle plates define the first and second surfaces of the angle members which abut the outer surfaces of the bottom channels of adjacent panels.

9. A pool, comprising:

a plurality of similarly sized and generally rigid panels, said panels having side flanges extending along the side edges of the panels and an upper channel extending along the upper edge of the panels, a plurality of generally vertically extending rigidizer members coupled with the side flanges of the adjacent panels, said ridigizer member comprised of a first leg portion fixed in abutment with the side flange of a panel and a second leg portion in abutment with a main portion of the panel, a plurality of degree angle members coupled between each adjacent panel side flange, said degree angle members having a top outer degree angle plate positioned against an outer surface of the upper channels of adjacent panels, said top outer degree angle plates defining the first and second surfaces of the degree angle members which abut the outer surfaces of the upper channels of adjacent panels, said degree angle members also having first and second surfaces extending at identical fixed angles to each other and in contact with the side flanges of adjacent panels, said fixed angles corresponding with the generally equal angles between the adjacent panels to ensure that adjacent panels extend at the proper angle to each other; and, said adjacent panels fixed together to define the perimeter of the pool, and said adjacent panels extend at a an angle to each other, and each said angle between said adjacent panels is generally equal.

10. The pool of claim 9, and further comprising an upright support extending generally vertically and being coupled at its upper portion to an angle member located near the top of adjacent panels, said upright support being coupled at its lower portion to an angle member located near the bottom of adjacent panels.

11. The pool of claim 10, wherein the upper portion of each upright support extends generally horizontally and is fixed with a generally vertically extending portion of the upright support, and walkway members extend between and are operatively coupled with the upper portions of adjacent upright supports.

12. The pool of claim 9 and further comprising a pair of side skirts fixed with opposite sides of the upright support.

13. The pool of claim 9, wherein each rigidizer member further comprises a first leg portion fixed in abutment with the side flange of a panel and a second leg portion in abutment with a main portion of the panel, an upright support extends generally vertically and is coupled at its upper portion to an angle member located near the top of adjacent panels and being coupled at its lower portion to an angle member located near the bottom of adjacent panels; and a pair of side skirts fixed with respective opposite sides of the upright support and each side skirt is also fixed with a respective rigidizer.

14. The pool of claim 9, and further comprising a fence post coupled with and extending upwardly from the generally vertically extending portion of the upright member.

15. A pool, comprising:

a plurality of similarly sized and generally rigid panels, said panels having side flanges extending along the side edges of the panels and an upper channel extending along the upper edge of the panels, an upright support extending generally vertically and having an upper portion operatively coupled with at least one panel near the top of the panel, said upright support having a lower portion operatively coupled with at least one panel near the bottom of the panels, a plurality of degree angle members coupled between each adjacent panel side flange, said degree angle members having a top outer degree angle plate positioned against an outer surface of the upper channels of adjacent panels, said top outer degree angle plates defining the first and second surfaces of the degree angle members which abut the outer surfaces of the upper channels of adjacent panels, said degree angle members also having first and second surfaces extending at identical fixed angles to each other and in contact with the side flanges of adjacent panels, said fixed angles corresponding with the generally equal angles between the adjacent panels to ensure that adjacent panels extend at the proper angle to each other; and, said adjacent panels fixed together to define the perimeter of the pool.

16. The pool of claim 15, and further comprising a pair of side skirts fixed with opposite skies of the upright support.

17. The pool of claim 15, wherein the upright support further comprises a generally horizontally extending upper portion and a generally vertically extending portion coupled with the upper portion, and walkway members extend between and are operatively coupled with the upper portions of adjacent upright supports.

18. The pool of claim 15, and further comprising a fence post coupled with and extending upwardly from the generally vertically extending portion of the upright member.

* * * * *